US005467728A

United States Patent [19]

Lucy et al.

[11] Patent Number: 5,467,728

[45] Date of Patent: Nov. 21, 1995

[54] RETRACTABLE BOW DIVING PLANE FOR A SUBMARINE

[75] Inventors: William D. Lucy, Virginia Beach; William F. Firman, Poquoson, both of Va.

[73] Assignee: The United States of America as represented by the Secretary of the Navy, Washington, D.C.

[21] Appl. No.: 264,120

[22] Filed: Jun. 22, 1994

[51] Int. Cl.[6] ..... B63E 8/18

[52] U.S. Cl. ..... 114/332; 114/126; 114/152

[58] Field of Search ..... 114/126, 282, 114/332, 152, 138, 141

[56] References Cited

U.S. PATENT DOCUMENTS 1,428,335 9/1922 Kolvig ..... 114/332

2,550,752 5/1951 Allan ..... 114/126

FOREIGN PATENT DOCUMENTS 0832715 4/1960 United Kingdom ..... 114/126

*Primary Examiner*—Sherman Basinger

*Attorney, Agent, or Firm*—Edward J. Connors, Jr.; William C. Townsend

[57] ABSTRACT

A retractable bow diving plane is provided which can be rotated when fully extended or retracted or when at any position in between, and which allows for independent operation of the port and starboard bow diving planes. The major assemblies for each plane are a large rotor bearing, four rotational hydraulic cylinders, and an extension and retraction hydraulic cylinder assembly. The plane is engaged in a slot in the middle of the rotor bearing. This rotor bearing supports the plane, rotates the plane, and allows the plane to move through the slot for extension and retraction.

13 Claims, 6 Drawing Sheets

RETRACTABLE BOW DIVING PLANE FOR A SUBMARINE

FIELD OF THE INVENTION

This invention provides a retractable bow diving plane which uses a large rotor bearing, slightly larger in diameter than the width of the diving plane. The bow plane is engaged in a slot in the middle of the bearing. The bearing supports the plane, rotates the plane, and allows the plane to move through the slot for extension and retraction of the plane.

BACKGROUND OF THE INVENTION

Submarine bow diving planes may be designed to be capable of extending out of and retracting back into the hull of the submarine. Without such a capability, the bow diving planes could be damaged or cause damage to other ships or adjacent structures by inadvertent, uncontrolled movement of the submarine during rough weather. This is a particular concern when the submarine is moored alongside a pier or another ship, such as a tender. Further, it is desirable that the planesman be able to select whether the bow diving planes are in the extended or the retracted position as the submarine travels at sea.

The major assemblies involved in operating existing bow plane systems are the hydraulic tilt mechanism, the control surface shafting and bearings, and the interlock mechanism. The hydraulic tilt mechanism rotates the bow planes to the commanded angle when the planes are in the extended position. It consists of a hydraulic cylinder, located inside the pressure hull, and a mechanical linkage, which connects the hydraulic cylinder to the control surface shaft and bearing assembly located outside the pressure hull.

This existing bow diving plane design limits the bow planes in two respects. First, the bow planes must be fully extended before they can be rotated. Therefore, the only parameter which can be varied to control the hydrodynamic forces on the bow planes is the bow plane angle. Second, the port and starboard planes are constrained to rotate together because they are connected to a common shaft and ,operated by a single hydraulic tilting mechanism. Independent operation of the two bow planes would improve the stability of the submarine by counteracting its tendency to roll under certain operating conditions. Specifically, during a roll, independent bow planes could be set such that one bow plane has a rise angle and the other has a dive angle. This would apply a restoring moment to the submarine.

On existing submarines, the bow planes are more complex than the stern planes or the rudder in several respects. The interlock system and automatic greasing system are both unique to the bow planes. Also, the shaft and bearing assembly is more complex than that on any other control surfaces because it must transmit torque to the bow planes and telescope to extend and retract the planes. This complex system adds weight to the submarine and significantly increases the cost of purchase and maintenance of the submarine bow planes.

The automatic greasing system requires four hull penetrations for grease lines. The use of a hydraulic cylinder inside the pressure hull to operate the equipment outside the pressure hull results in the need for a hull penetration with a dynamic seal. The hull penetration is subject to submarine safety (SUBSAFE) requirements because the penetration affects the pressure integrity of the hull. In general, penetrations in the pressure hull are undesirable, but dynamic penetrations are even more so because they are difficult to maintain watertight. The dynamic seal makes the alignment between the piston rod and the operating rod critical to preventing binding at the hull penetration between the operating rod and the packing which seals around the rod. The interlock mechanism suffers from these same disadvantages because it also employs an inboard hydraulic cylinder to operate outboard equipment.

SUMMARY OF THE INVENTION

This retractable bow diving plane includes a large rotor bearing, slightly larger in diameter than the width of the diving plane. The bow plane is at all times engaged in a slot in the middle of the bearing. The bearing supports the plane, rotates the plane, and allows the plane to move through the slot for extension and retraction.

Self-lubricating bearings are used at all locations where relative sliding or rotation occurs between components. This eliminates the need for the automatic greasing system used with existing bow planes. Self-lubricating bearings last longer and cost less than the cobalt-chromium-tungsten bearings used on existing bow plane systems.

The major assemblies for each bow diving plane are a large rotor bearing, four rotational hydraulic cylinders, and an extension and retraction hydraulic cylinder assembly. This system allows the bow planes to be rotated when fully extended or retracted or when at any position in between, and allows independent operation of the port and starboard planes. Independent operation of the planes could improve submarine control by providing the capability to counteract submarine roll. The bow planes could be rotated at different angles or in opposite directions to apply a restoring moment to the submarine during a roll. This could be accomplished by an automatic control system using ship's roll and bow plane position signals from monitoring systems which currently exist on the submarine.

The subject invention improves submarine maintainability by replacing the one large hydraulic cylinder used on existing systems to rotate both planes with four small hydraulic cylinders to rotate each plane. In the event of a failure of a hydraulic cylinder, the failed cylinder could be hydraulically isolated until repairs could be accomplished. Further, during repair or replacement, the relatively small cylinders of the subject invention would be easier to remove and install than the large hydraulic cylinder of the existing system.

BRIEF DESCRIPTION OF THE DRAWINGS

The invention will be best understood by referring to the accompanying drawings, wherein.

DETAILED DESCRIPTION

Figure 1:
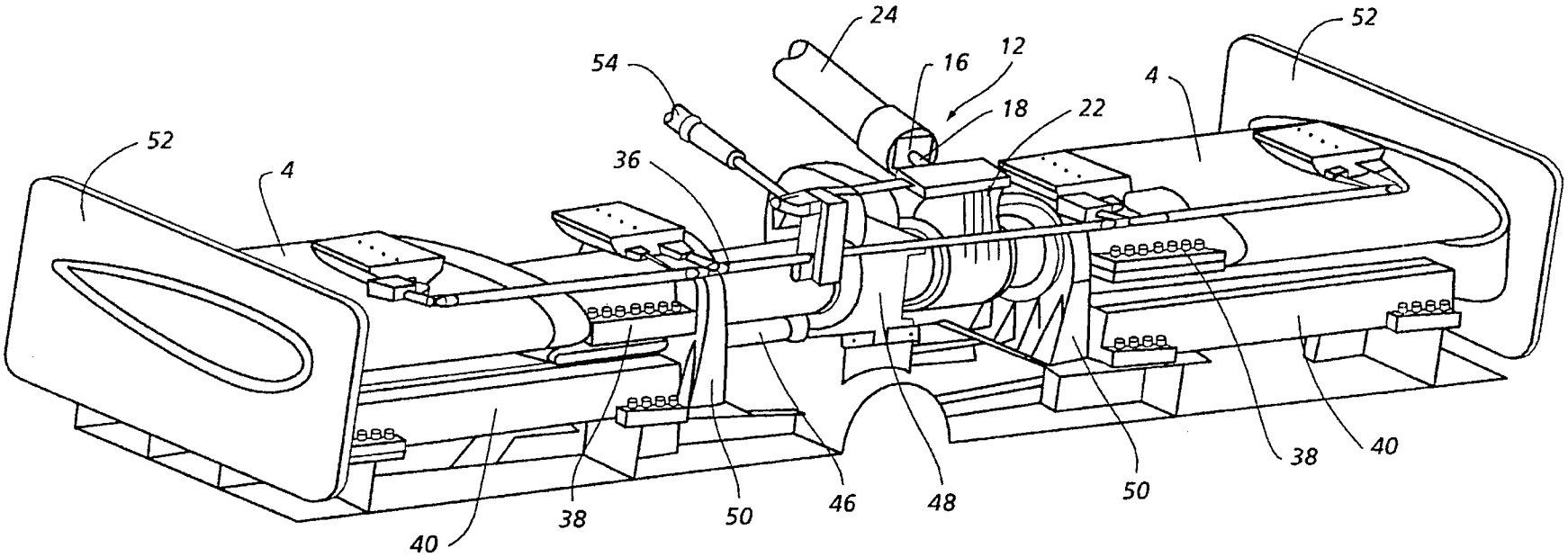
PRIOR ART FIG. 1
FIG. 1 and FIG. 2 illustrate the bow diving plane gear used on existing submarines.
Figure 2:
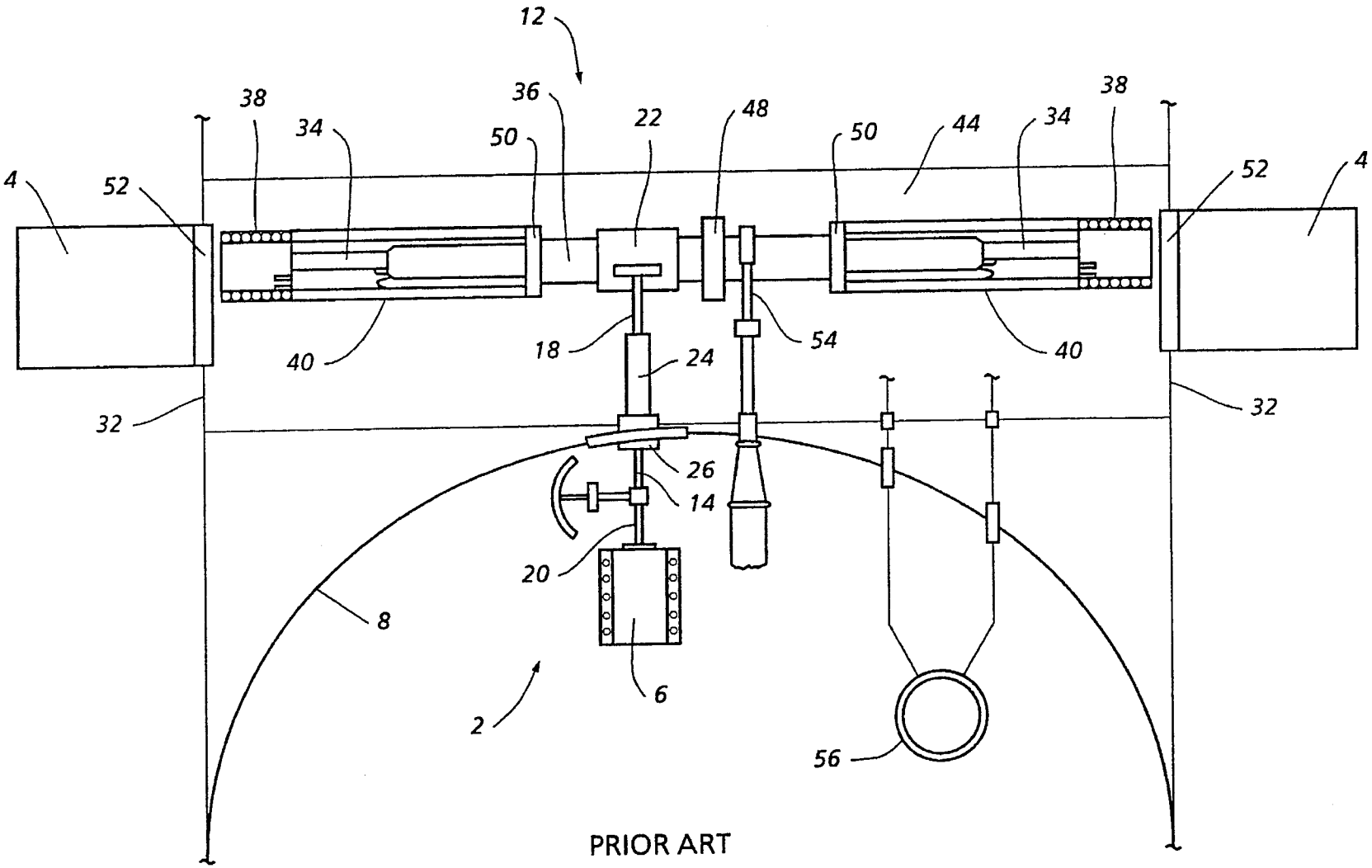
PRIOR ART FIG. 2

FIG. 1 and FIG. 2 illustrate the bow diving plane system used on existing submarines. The hydraulic tilt mechanism 2 rotates the bow planes 4 to the commanded angle when the bow planes 4 are in the extended position. The hydraulic tilt mechanism 2 includes a hydraulic cylinder 6 located inside the pressure hull 8. The hydraulic cylinder 6 is mechanically linked to a control surface shaft assembly 12. The mechanical connection between the hydraulic cylinder 6 and the control surface shaft assembly 12 includes an operating rod 14, a crosshead guide piston 16, and a connecting rod 18. The operating rod 14 connects rigidly to the hydraulic cylinder piston rod 20, penetrates through the submarine pressure hull 8, and connects rigidly to the crosshead guide piston 16. The connecting rod 18 is pinned to the crosshead guide piston 16 at one end and the internally splined tiller 22 at the other end. The crosshead guide piston 16 slides in a guide cylinder 24 welded to the pressure hull 8. A packing and bearing assembly 26 seals the opening in the guide cylinder 24 for the operating rod 14, and supports the operating rod 14.

The piston of the hydraulic cylinder 6 drives the hydraulic cylinder piston rod 20, operating rod 14, and crosshead guide piston 16 back and forth. The connecting rod 18, by a combination of both linear and angular motion, drives the internally splined tiller 22 of the control surface shaft assembly 12. The internally splined tiller 22 rotates the control surface shaft assembly 12 and the bow planes 4.

The control surface shaft assembly 12 is made up of a series of splined shaft sections which telescope in and out of one another to permit the bow planes 4 to move in and out of the non-pressure hull 32. Each bow plane 4 is fitted with an externally splined stock 34. The stocks 34 engage internally splined stock end caps on the inboard ends. The end caps are also externally splined and engage a single internally splined torque tube 36 in the middle of the control surface shaft assembly 12. The internally splined tiller 22 engages external splines on the torque tube 36. This series of internally and externally splined shaft sections transmits torque to rotate the bow planes 4 while allowing relative axial movement of the bow planes 4. Each splined shaft section requires precision machining for alignment of the assembly and to minimize angular backlash when the bow planes 4 are rotated. The control surface shaft assembly 12 is supported by five journal type bearings. These bearings maintain alignment of mating control surface shaft assembly 12 sections and limit deflections of the control surface shaft assembly 12 resulting from hydrodynamic loads on the bow planes 4.

One stock bearing is fixed to each stock 34 just inboard of the bow plane 4. These stock bearings are housed in stock bearing carriers 38. The stock bearing carriers 38 ride on guide rails 40 mounted underneath the control surface shaft assemblies 12. The stock bearing carriers 38 move the bow planes 4 into and out of the bow plane enclosure 44. A single extension and retraction cylinder 46 with two opposed piston and rod assemblies provides power to move the stock bearing carriers 38 along the guide rails 40. The centerline bearing 48 and pedestal bearings 50 are stationary.

In order to rotate the bow planes 4, the bow planes 4 must first be extended through and completely clear of openings in the bow plane fairings 52. These openings are the same shape as the bow plane 4 cross section except slightly larger. The bow planes 4 only line up with the openings when the bow planes 4 are positioned precisely at zero angle, and consequently can only be extended or retracted when positioned precisely at zero angle. Operation of the bow planes 4 in the retracted position or retracting the bow planes 4 while at a non-zero angle would damage the bow plane fairings 52 and the bow planes 4. To prevent such damage, the bow planes 4 are equipped with an interlock mechanism 54.

The bow planes 4 are equipped with an automatic greasing system 56. This automatic greasing system 56 greases all of the outboard components which require lubrication. The automatic greasing system 56 greases the components whenever the bow planes 4 are extended or retracted and once every hour during operation. The automatic greasing system 56 is necessary because so many of the components require greasing that manual greasing would be impractical.

Figure 3:
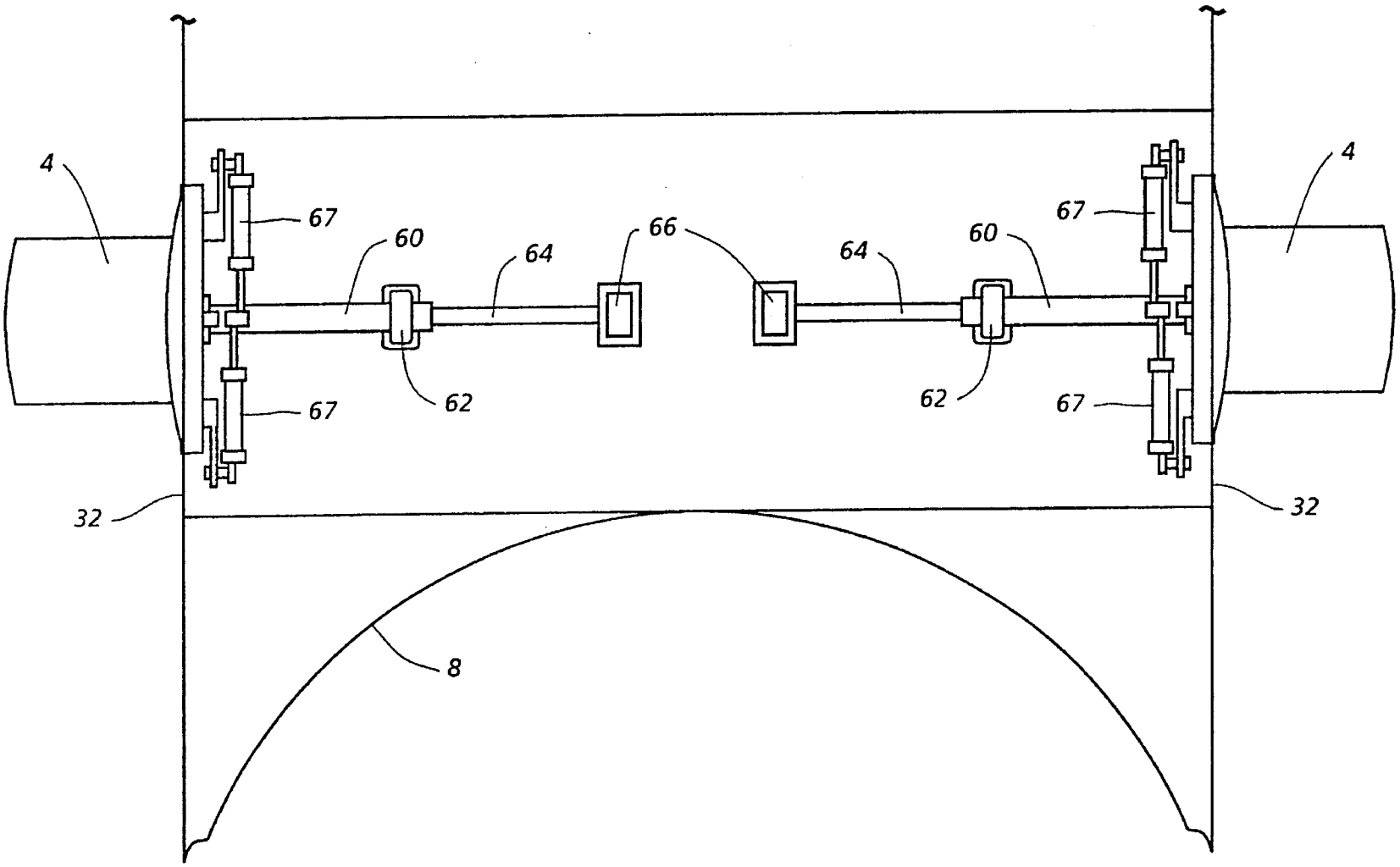
FIG. 3 illustrates the port and starboard bow diving plane gear of the subject invention.

FIG. 3 illustrates the port and starboard bow plane 4 extension and retraction assembly of the subject invention. The extension and retraction hydraulic cylinders 60 extend and retract the bow planes 4. One end of each extension and retraction hydraulic cylinder 60 is rigidly connected to a bow plane 4. The opposite end of each extension and retraction hydraulic cylinder 60 is supported in a journal bearing 62. The journal bearings 62 allow the extension and retraction hydraulic cylinders 60 to rotate with the bow planes 4, and also allow the extension and retraction hydraulic cylinders 60 to slide through the journal bearings 62 as the bow planes 4 extend and retract. This arrangement enables the barrel of the extension and retraction hydraulic cylinders 60 to carry the moment loads. The journals for the journal bearings 62 are manufactured from a self-lubricating material. These journals have a spherical seat to allow for misalignment caused by bending of the extension and retraction hydraulic cylinders 60 under hydrodynamic loads. The piston rods 64 are stationary. These piston rods 64 are fixed at the inboard ends to support bearings 66 which support the axial loads on the piston rods 64 during extension and retraction of the bow planes 4. The extension and retraction hydraulic cylinders 60, journal bearings 62, piston rods 64, and support bearings 66 are located in the bow plane enclosure 44 within the non-pressure hull 32. They do not extend into the pressure hull 8.

The hydraulic power required to extend and retract the extension and retraction hydraulic cylinders 60 and rotate the rotational hydraulic cylinders 67 is provided from one or more hydraulic power plants located inside the pressure hull 8 or, preferably, from one or more power plants in the bow plane enclosure 44. Hydraulic oil to actuate the extension and retraction hydraulic cylinders 60 is supplied through flexible hoses or, preferably, through holes drilled along the length of the piston rods 64 and connected to hydraulic piping at the support bearings 66. Hydraulic oil to actuate the rotational hydraulic cylinders 67 is supplied through flexible hoses.

Figure 4:
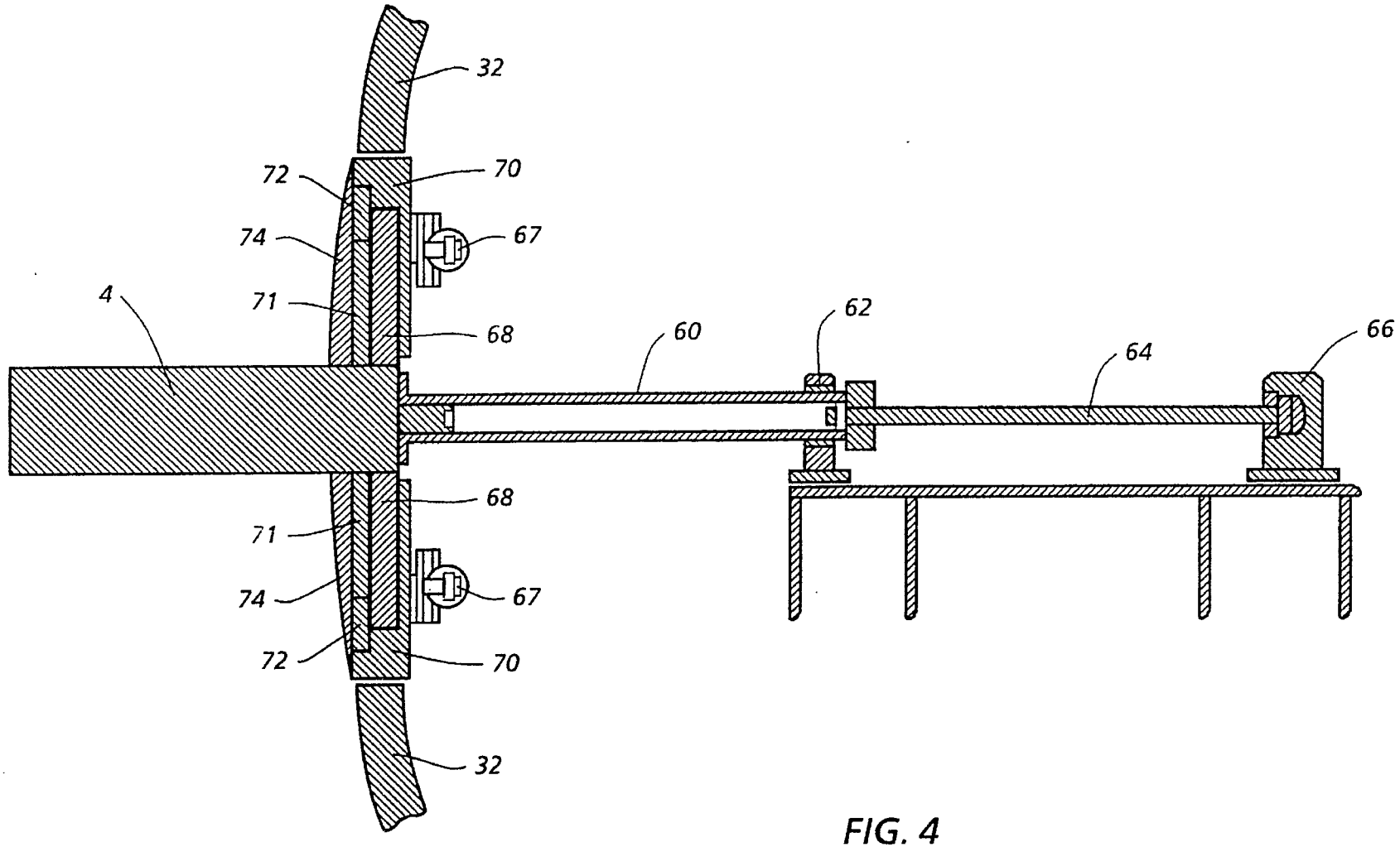
FIG. 4 is a cross sectional view of the starboard bow plane assembly with the bow plane in the extended position.
Figure 5:
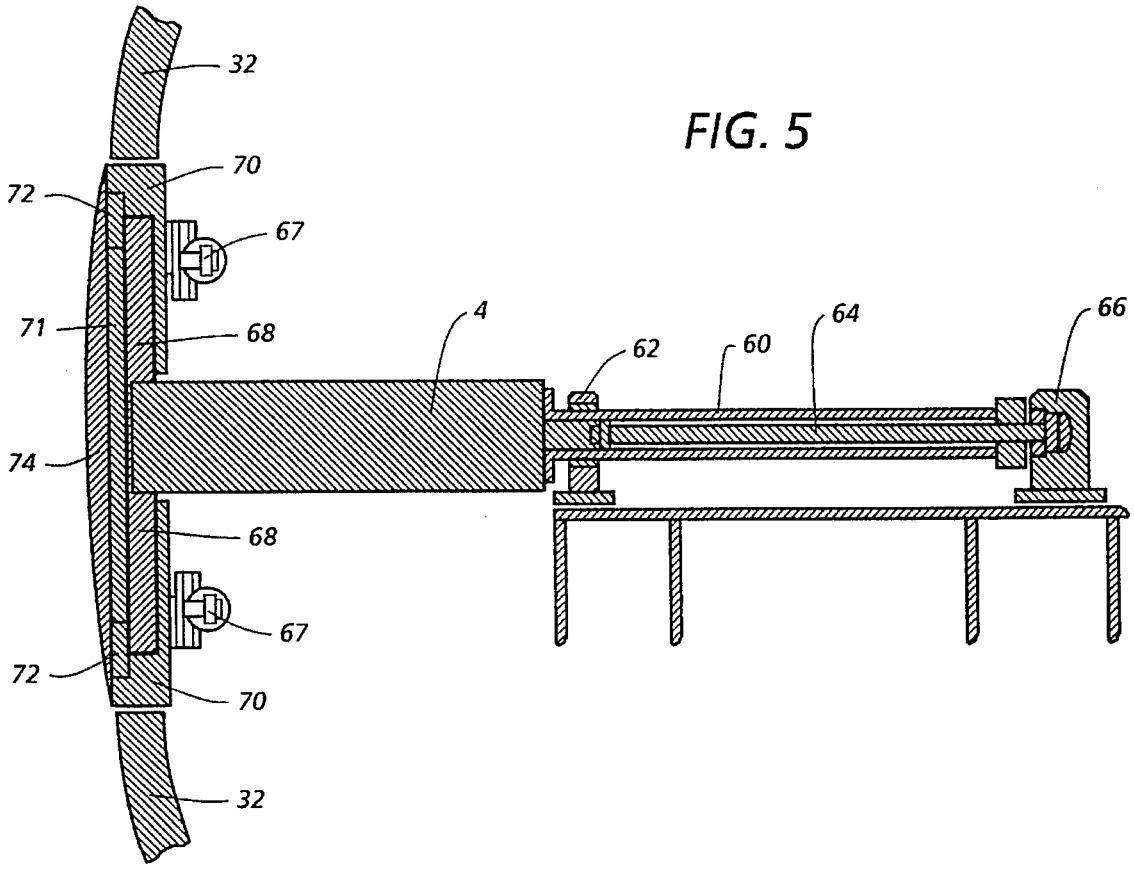
FIG. 5 is a cross sectional view of the starboard bow diving plane assembly with the diving plane in the retracted position.

FIG. 4 and FIG. 5 are cross sectional views of the starboard bow plane 4 assembly. One end of the extension and retraction hydraulic cylinder 60 is rigidly connected to the bow plane 4. The piston rod 64 extends from the journal bearing 62 to the support bearing 66.

The rotor bearing 68 is slightly larger in diameter than the width of the bow plane 4. The bow plane 4 is at all times engaged in a slot in the middle of the rotor bearing 68. The rotor bearing 68 supports the bow plane 4, rotates the bow plane 4, and allows the bow plane 4 to move through the slot so that the bow plane 4 can be extended and retracted. This allows the bow plane 4 to be rotated when fully retracted, fully extended, or at any position in between. The main bearing elements for the rotor bearing 68 should be manufactured from self-lubricating materials.

The bearing housing 70, bearing retainer 71, and retaining ring 72 are coaxial to the rotor bearing 68, and secure the rotor bearing 68 in the proper position. A lightweight fairing 74 covers the external face of the rotor bearing 68 and rotates with the rotor bearing 68.

Four rotational hydraulic cylinders 67 rotate the rotor bearing 68 and bow plane 4. The piston rods of the rotational hydraulic cylinders 67 are pin-connected to the rotor bearing 68, and the cylinder bodies of the rotational hydraulic cylinders 67 are pin-connected to the non-pressure hull 32. These pin connections allow the orientation of the rotational hydraulic cylinders 67 to change as the rotor bearing 68 and bow plane 4 rotate. Two rotational hydraulic cylinders 67 rotate the rotor bearing 68 and bow plane 4 clockwise, and the other two rotational hydraulic cylinders 67 rotate the rotor bearing 68 and bow plane 4 counterclockwise. The rotational hydraulic cylinders 67 can be arranged such that one rotational hydraulic cylinder 67 could rotate the rotor bearing 68 and bow plane 4 in the event of a failure of the other three rotational hydraulic cylinders 67.

Figure 6:
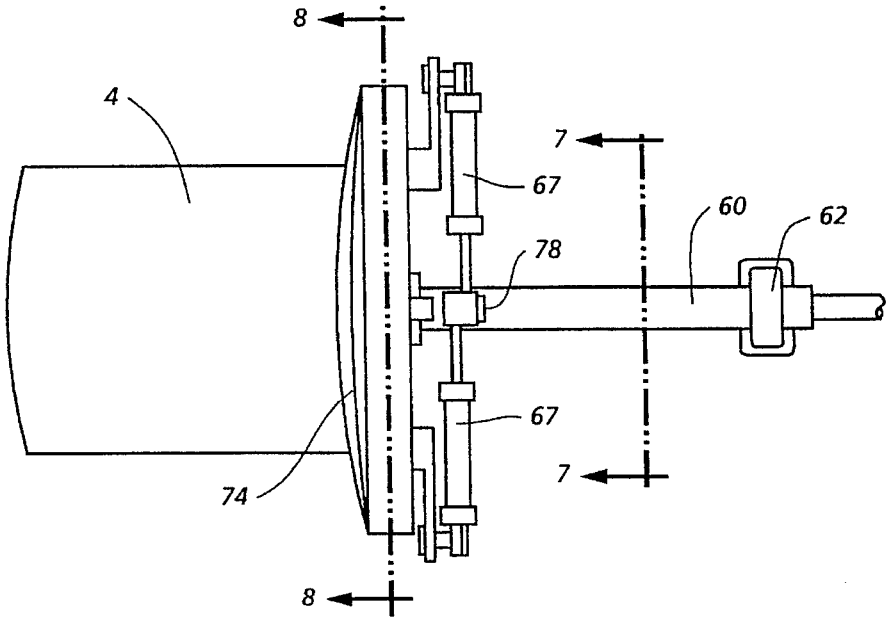
FIG. 6 illustrates the bow plane assembly with the bow plane in the extended position.

FIG. 6 illustrates the bow plane 4 assembly with the bow plane 4 in the extended position. One end of the extension and retraction hydraulic cylinder 60 is rigidly connected to the bow plane 4. The opposite end of each extension and retraction hydraulic cylinder 60 is supported in a journal bearing 62. The fairing 74 reduces water turbulence. The fairing 74 is manufactured from fiberglass or other non-metallic material. Rotational hydraulic cylinders 67 and tillers 78 rotate the bow plane 4.

Figure 7:
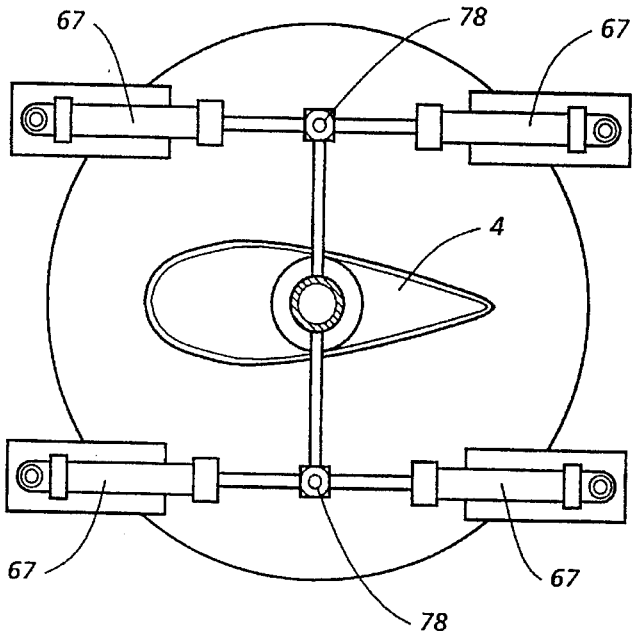
FIG. 7 is a view of the bow plane assembly taken on line 7—7 of FIG. 6.

FIG. 7 is a view of the bow plane 4 assembly taken on line 7—7 of FIG. 6. Rotational hydraulic cylinders 67 and tillers 78 rotate the bow plane 4.

Figure 8:
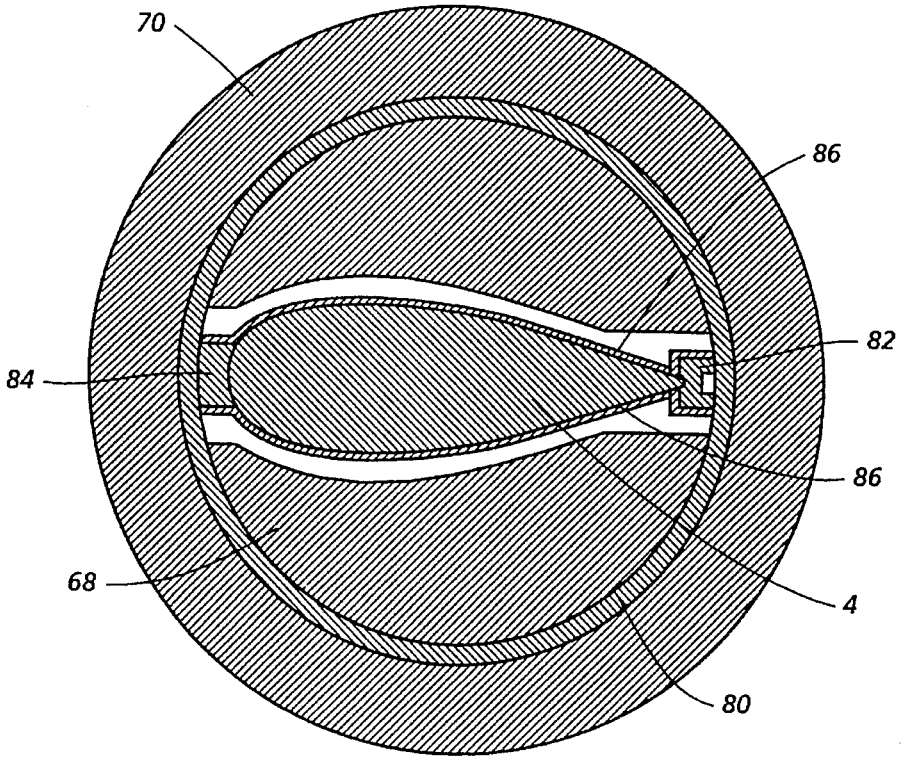
FIG. 8 is a view of the bow plane assembly taken on line 8—8 of FIG. 6.

FIG. 8 is a cross sectional view of the bow plane 4 assembly taken on line 8—8 of FIG. 6. The bow plane 4 is engaged in a slot in the middle of the rotor bearing 68. The bearing housing 70 is coaxial to the rotor bearing 68. The main bearing element 80 is a self-lubricating material. The aft plane roller assembly 82 and the forward plane roller assembly 84 are mounted on the rotor bearing 68 at the forward and aft ends of the slot in the rotor bearing 68. The aft plane roller assembly 82 and forward plane roller assembly 84 maintain the proper fore/aft alignment of the bow plane 4 under the force of hydrodynamic loads (primarily drag) on the bow plane 4. The aft plane roller assembly 82 and the forward plane roller assembly 84 also decrease the force required to extend and retract the bow plane 4. The plane support pad bearings 86 conform to the curvature of the bow plane 4 and are mounted in the slot in the rotor bearing 68. The plane support pad bearings 86 maintain the vertical alignment of the bow plane 4 under the action of hydrodynamic loads (primarily lift) on the bow plane 4. The plane support pad bearings 86 also support the weight of the bow plane 4. In order to minimize friction and thus reduce the force required to extend and retract the bow plane 4, the plane support pad bearings 86 should be made from a self-lubricating bearing material.

All bearings in the subject invention are manufactured from self-lubricating materials to eliminate greasing requirements. A number of materials are available which have good strength and wear resistance and are suitable for use in sea water. One such material, sold under the brand name "TUFLITE", is manufactured by Rexnord Corp., P.O. Drawer 2022, Milwaukee, Wis., USA 53201. "TUFLITE" is a composite consisting of a Teflon-Dacron bearing surface backed by fiberglass for structural strength. "TUFLITE" has been used successfully in submarine stock bearings and connecting rod bushings. Another suitable material, sold under the brand name "SLX", is manufactured by Thordon Bearings Inc., 3225 Mainway, Burlington, Ontario, Canada L7M1A6. "SLX" is a high strength, homogeneous plastic bearing material which has been used successfully in marine applications. Either "TUFLITE" or "SLX" would be suitable for any of the bearings, although a homogeneous material such as "SLX" would be preferable for the plane support pad bearings.

This invention has been described in detail with particular reference to certain preferred embodiments thereof, but it should be understood that variations and modifications can be effected within the spirit and scope of the invention. It is particularly noted that this invention could be used in the design of stern diving planes and rudders. It is further noted that the rotational hydraulic cylinders could be replaced by electro-hydraulic actuators. An electro-hydraulic actuator is a hydraulic cylinder with an integral electric motor-driven hydraulic pump and electrical positioning equipment. The electro-hydraulic actuator is completely self-contained, requiring only electrical power and an electrical positioning signal. The electro-hydraulic actuators would be located in the bow plane enclosure. High torque, low speed electric/hydraulic motors could also be used to rotate the rotor bearings and bow planes using any conventional drive mechanism. It is further noted that the extension and retraction hydraulic cylinders and piston rods could be replaced by a power screw. The screw would be driven by an electric motor or a rotary hydraulic actuator. An externally threaded rod would engage an internally threaded shaft connected to the bow plane. The shaft would support the bending moment on the bow plane and slide through the journal bearing. The rotary hydraulic actuator or electric motor would be mounted in the support bearing.

What is claimed is:

1. A submarine control device comprising:

a diving plane, a rotor bearing having a slot, said diving plane being engaged in said slot, whereby said rotor bearing supports said diving plane as said diving plane is extended and retracted through said slot in said rotor bearing, an extension and retraction hydraulic cylinder, said extension and retraction hydraulic cylinder being rigidly connected to said diving plane, whereby said extension and retraction hydraulic cylinder supports the moment of force from said diving plane, a journal bearing which supports said extension and retraction hydraulic cylinder, a piston rod which supports the axial force from said diving plane, a support bearing supporting said piston rod, and a rotational hydraulic cylinder which rotates said rotor bearing and said diving plane.

2. The submarine control device of claim 1 further comprising:

a fairing, wherein said fairing covers the external face of said rotor bearing and rotates with said rotor bearing.

3. A control device comprising:

a plane, a rotor bearing with a slot, said plane being engaged in said slot in said rotor bearing, whereby said rotor bearing supports said plane as said plane is extended and retracted through said slot in said rotor bearing, a bearing housing, a bearing retainer, a retaining ring, said bearing housing, said bearing retainer and said retaining ring being coaxial to said rotor bearing, whereby said bearing housing, said bearing retainer and said retaining ring secure said rotor bearing in the proper position, and a main bearing element which permits said rotor bearing to rotate within said bearing housing.

4. The control device of claim 3 further comprising:

an aft plane roller assembly mounted on the aft end of said slot in said rotor bearing, and a forward plane roller assembly mounted on the forward end of said slot in said rotor bearing, whereby, said aft plane roller assembly and said forward plane roller assembly maintain the proper alignment of said plane and also decrease the force required to extend and retract said plane.

5. The control device of claim 4 further comprising:

a plane support pad bearing, whereby, said plane support pad bearing supports the weight of said plane and also maintains the vertical alignment of said plane.

6. The control device of claim 5 further comprising:

a fairing, wherein said fairing covers the external face of said rotor bearing and rotates with said rotor bearing.

7. The control device of claim 6 further comprising:

a rotational hydraulic cylinder, wherein, said rotational hydraulic cylinder rotates said rotor bearing and said plane.

8. The control device of claim 7 further comprising:

an extension and retraction hydraulic cylinder, wherein said extension and retraction hydraulic cylinder is rigidly connected to said plane, whereby, said extension and retraction hydraulic cylinder supports the moment of force from said plane, a journal bearing, wherein, said journal bearing supports said extension and retraction hydraulic cylinder, a piston rod, whereby said piston rod supports the axial force from said plane, and a support bearing, wherein, said support bearing supports said piston rod.

9. A retractable bow diving plane comprising:

a bow diving plane, an extension and retraction hydraulic cylinder rigidly connected to said bow diving plane, whereby said extension and retraction hydraulic cylinder supports the moment of force from said bow diving plane, a journal bearing which supports said extension and retraction hydraulic cylinder, a piston rod which supports the axial force from said bow diving plane, a support bearing which supports said piston rod, a rotor bearing having a slot in which said bow diving plane is engaged, whereby said rotor bearing supports said bow diving plane as said bow diving plane is extended and retracted through said slot in said rotor bearing, a bearing housing, a bearing retainer, a retaining ring, said bearing housing, said bearing retainer and said retaining ring being coaxial to said rotor bearing, whereby said bearing housing, said bearing retainer and said retaining ring secure said rotor bearing in the proper position, and a main bearing element which permits said rotor bearing to rotate within said bearing housing.

10. The retractable bow diving plane of claim 9 further comprising:

an aft plane roller assembly mounted on the aft end of said slot in said rotor bearing, and a forward plane roller assembly mounted on the forward end of said slot in said rotor bearing, whereby, said aft plane roller assembly and said forward plane roller assembly maintain the proper alignment of said bow diving plane and also decrease the force required to extend and retract said bow diving plane.

11. The retractable bow diving plane of claim 16 further comprising:

a plane support pad bearing, whereby, said plane support pad bearing supports the weight of said bow diving plane and also maintains the vertical alignment of said bow diving plane.

12. The retractable bow diving plane of claim 11 further comprising:

a fairing, wherein said fairing covers the external face of said rotor bearing and rotates with said rotor bearing.

13. The retractable bow diving plane of claim 12 further comprising:

a rotational hydraulic cylinder, wherein, said rotational hydraulic cylinder rotates said rotor bearing and said bow diving plane.

* * * * *